US006302483B1

(12) United States Patent
Ricaud et al.

(10) Patent No.: US 6,302,483 B1
(45) Date of Patent: Oct. 16, 2001

(54) REVOLVING SEAT, IN PARTICULAR FOR A RAIL VEHICLE

(75) Inventors: Patrick Ricaud, Perigny (FR); Bernard Mormede, Seoul (KR)

(73) Assignee: Alstom Holdings, Paris (FR)

( * ) Notice: Subject to any disclaimer, the term of this patent is extended or adjusted under 35 U.S.C. 154(b) by 0 days.

(21) Appl. No.: 09/439,080

(22) Filed: Nov. 12, 1999

(30) Foreign Application Priority Data

Nov. 13, 1998 (FR) ..... 98 14291

(51) Int. Cl.[7] ..... A47C 1/02
(52) U.S. Cl. ..... 297/344.24; 297/344.22
(58) Field of Search ..... 297/344.24, 344.22, 297/344.26; 248/425

(56) References Cited

U.S. PATENT DOCUMENTS

| | | | | |
|---|---|---|---|---|
| 1,735,321 | | 11/1929 | Kilburn . | |
| 1,741,784 | | 12/1929 | Lucas . | |
| 2,247,264 | | 6/1941 | Van Derveer . | |
| 3,066,979 | * | 12/1962 | Pitts et al. | 297/344.24 X |
| 3,394,964 | * | 7/1968 | Humphries et al. | 248/425 X |
| 4,417,715 | | 11/1983 | Edwards . | |
| 4,822,099 | * | 4/1989 | Negi et al. | 297/344.22 |
| 4,824,170 | * | 4/1989 | Goldmeier | 297/344.26 |
| 5,046,782 | * | 9/1991 | Lundeen | 297/344.26 |
| 5,634,537 | * | 6/1997 | Thorn | 297/344.22 X |
| 5,636,884 | * | 6/1997 | Ladetto et al. | 297/344.24 X |
| 6,027,170 | * | 2/2000 | Benz et al. | 297/344.26 X |

* cited by examiner

*Primary Examiner*—Peter M. Cuomo
*Assistant Examiner*—Stephen Vu
(74) *Attorney, Agent, or Firm*—Sughrue, Mion, Zinn, Macpeak & Seas, PLLC

(57) ABSTRACT

A seat has: a moveable upper part (14) for receiving at least one occupant, the moveable upper part being carried by a fixed lower part forming a substructure (16), and a turning mechanism (28) for turning the upper part (14) backwards and forwards. The turning mechanism (28) contains a pivot (30) connecting the upper part (14) and the substructure (16). The axis (Z) of this pivot is substantially vertical. The turning mechanism (28) also contains a slide (36) mounted on the upper part (14) so as to be displaceable in rotation about the pivot (30) and in translational motion substantially perpendicular to the axis (Z), and two complementary cams (46, 48) carried respectively by the substructure (16) and the upper part (14). One of the cams has a developing profile imparting a predetermined turning travel to the upper part (14).

12 Claims, 6 Drawing Sheets

REVOLVING SEAT, IN PARTICULAR FOR A RAIL VEHICLE

BACKGROUND OF THE INVENTION

The present invention relates to a revolving seat, in particular for a rail vehicle.

The prior art already discloses a seat of the type comprising a moveable upper part for receiving at least one occupant, the said moveable upper part being carried by a fixed lower part forming a substructure and means for turning the upper part backwards and forwards.

The seats of this type are arranged, in particular, in rail vehicles. The means for turning a seat make it possible to reverse the front/back orientation of the seat so as to place this seat and the passenger or passengers occupying it in the direction of travel of the vehicle, whatever the direction in which this vehicle makes a journey.

Conventionally, the seats of a rail vehicle are arranged in the vicinity of a left-hand or right-hand side wall of this vehicle.

Since the space between the seats and the adjacent side wall is preferably as small as possible, the movement of turning a seat backwards (and forwards) simply by rotating the moveable upper part of the seat about a fixed vertical axis is impeded by the side wall. The seat is therefore usually turned first by moving the moveable upper part away from the wall adjacent to the seat, then by rotating this moveable part about a vertical axis and finally by bringing this moveable part close to the wall adjacent to the seat.

BRIEF SUMMARY OF THE INVENTION

The object of the invention is to provide a seat, in particular for a rail vehicle, equipped with turning means of small overall size which are light and simple to operate, in order to make it possible to reverse rapidly the front/back orientation of all the seats of a rail vehicle.

For this purpose, the subject of the invention is a seat of the abovementioned type, characterized in that the turning means comprise a pivot connecting the upper part and the substructure, the axis of this pivot being substantially vertical and connected to the substructure, a bearing-forming slide mounted on the upper part so as to be displaceable in rotation about the pivot and in translational motion substantially perpendicular to the axis of this pivot, and two complementary cams carried respectively by the substructure and the upper part, one of these cams comprising a developing profile imparting a predetermined turning travel to the upper part.

According to other characteristics of this seat:

- a first cam forms a finger integral with the substructure, and the second cam forms a guide having a developing profile and formed in the upper part, this guide extending substantially parallel to a plane perpendicular to the axis of the pivot;
- the guide comprises two straight end portions forming ramps imparting to the upper part displacements occurring as a result of a combination of a rotational movement about the axis of the pivot and of a translational movement substantially perpendicular to this axis of the pivot, and a curved intermediate portion imparting to the upper part a displacement in rotation about the axis of the pivot;
- the seat comprises releasable means for locking the upper part relative to the substructure;
- the locking means comprise means for clamping two mutually confronting friction faces substantially perpendicular to the axis of the pivot and delimiting respectively the upper part and the substructure, these clamping means being carried by the pivot;
- the pivot extends through mutually confronting walls of the upper part and of the substructure carrying the friction faces, and the clamping means comprise an end head of the pivot, the said end head forming a fixed jaw, and a moveable jaw mounted axially slideably on the pivot, the mutually confronting walls extending between the fixed jaw and the moveable jaw, the moveable jaw being elastically deformable axially and being displaceable between a decompressed position separating the friction faces and a compressed position clamping these friction faces;
- the moveable jaw is displaceable and compressible axially by co-operation with a cam articulated on the pivot about an axis substantially perpendicular to that of this pivot;
- the cam forms the end of a lever controlling the locking means;
- the friction face of the upper part comprises rolling members, preferably balls, displaceable substantially parallel to the axis of the pivot between the projecting position spacing apart the mutually confronting friction faces, in which position these members are in rolling contact with the friction face of the substructure, and the retracted position putting the mutually confronting friction faces into contact, the rolling members being returned elastically to the projecting position.

The subject of the invention is also a rail vehicle comprising a seat as defined above.

BRIEF DESCRIPTION OF THE DRAWINGS

The invention will be understood better from a reading of the following description given purely by way of example and made with reference to the drawings in which.

DETAILED DESCRIPTION OF THE INVENTION

Figure 1:
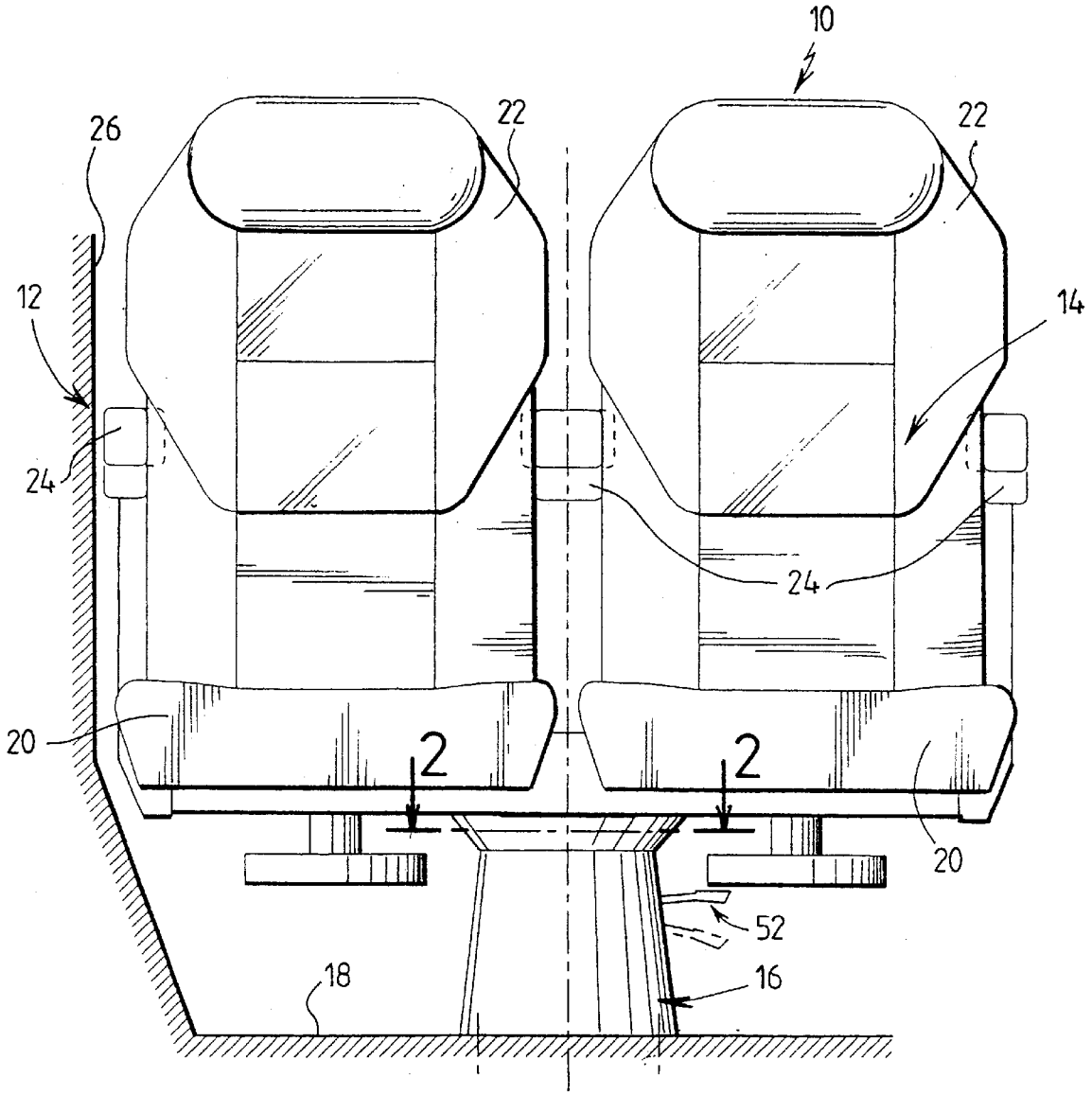
FIG. 1 is an elevation view of a seat according to the invention.

FIG. 1 illustrates a seat 10 according to the invention arranged in a rail vehicle 12.

The seat 10 comprises a moveable upper part 14 carried by a fixed lower part 16 integral with a floor 18 of the vehicle 12. The upper part 14 is intended to receive at least one occupant, for example two occupants, as illustrated in FIG. 1.

Conventionally, the upper part 14 comprises sitting-surface upholstery 20 and back upholstery 22 as well as armrests 24. The upper part 24 is arranged in the vicinity of a side wall 26 of the vehicle 12.

The seat 10 also comprises means 28 for turning the upper part 14 backwards and forwards. These turning means 28 are illustrated in more detail in FIGS. 2 to 9.

The turning means 28 comprise a pivot 30 connecting the upper part 14 and the substructure 16 of the seat. The geometric axis Z of this substantially vertical pivot 30 is linked to the substructure 16.

The pivot 30 extends through two mutually confronting, substantially horizontal walls, one 32 moveable and the other 34 fixed. The upper first wall 32 delimits a reinforcement of the upper part 14. The lower second wall 34 delimits the substructure 16.

The turning means 28 also comprise a slide 36 mounted displaceably in translational motion, substantially perpendicular to the axis Z, in a straight guide rail 38 formed in the upper part 32. The slide 36 forms a bearing mounted displaceably in rotation about the pivot 30. The rotation of the slide 36 is made easier by a needle bearing 40 inserted between the pivot 30 and the slide 36 (see FIGS. 3 to 5).

The pivot 30 extends through an oblong hole 42 which is elongated in a direction substantially parallel to that of the guide rail 38 and which is formed in the moveable upper wall 32. The pivot 30 likewise extends through a bearing-forming circular orifice 44 formed in the fixed lower wall 34.

The turning means 28 comprise, furthermore, two complementary cams carried respectively by the substructure 16 and the upper part 14.

A first cam forms a substantially vertical finger 46 integral with the lower wall 34. The second cam is delimited by a guide-forming groove 48 formed in the upper wall 32. This groove 48 extends substantially parallel to a plane perpendicular to the axis Z. The profile of the groove 48 develops so as to impart a predetermined turning travel to the moveable upper part 14.

Figure 2:
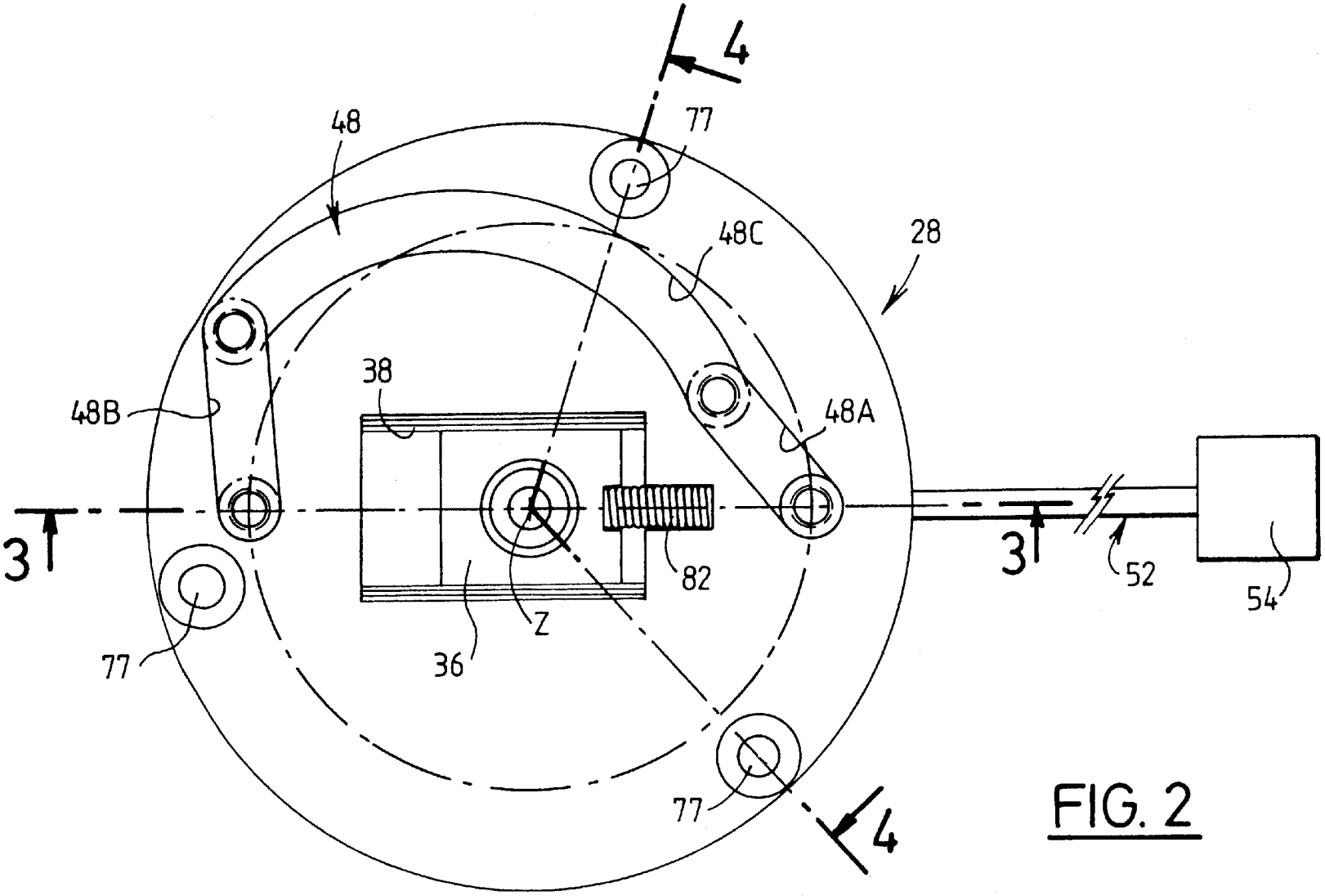
FIG. 2 is a sectional view along the line 2—2 of FIG. 1 on an enlarged scale.
Figure 6:
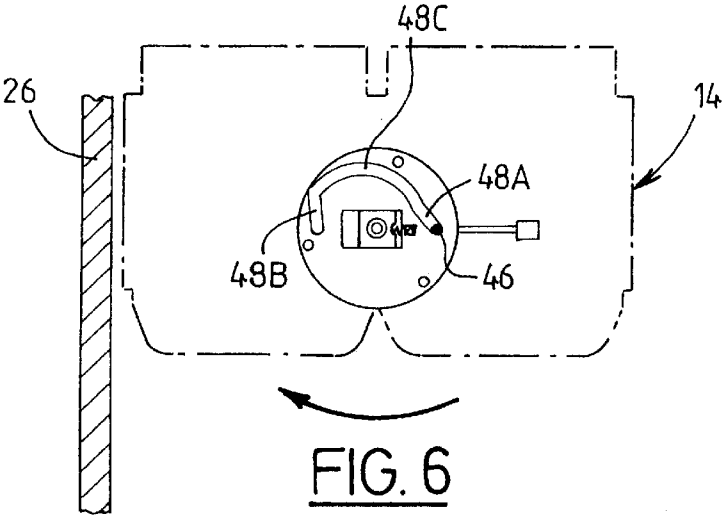
Figure 9:
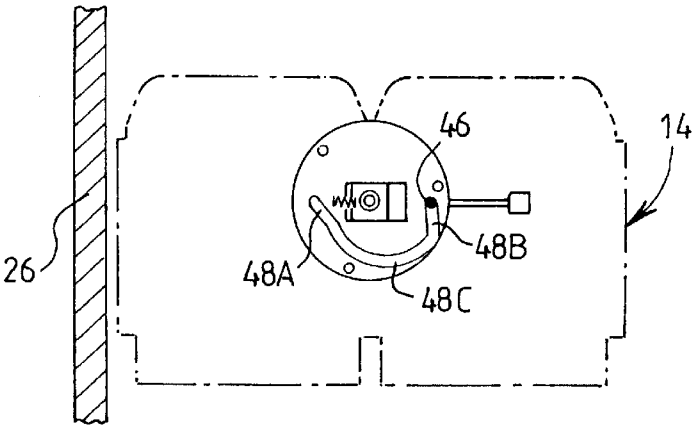

Referring more particularly to FIG. 2, it will be seen that the ends of the groove 48 are aligned substantially in a plane containing the axis Z and, by co-operating with the finger 46 define the two positions of the upper part 14 which are turned relative to one another and which correspond to the two positions of normal use of the seat, as illustrated in FIGS. 6 and 9.

The groove 48 comprises two straight end portions forming ramps 48A, 48B and a curved intermediate portion 48C.

The ramps 48A, 48B are inclined relative to the direction of translational displacement of the slide 36, with the result that these ramps co-operate with the finger 46, so as to impart to the upper part 14 displacements occurring as a result of a combination of a rotational movement about the axis Z and of a translational movement substantially perpendicular to this axis Z.

The curved portion 48C co-operates with the finger 46 so as to impart to the upper part 14 a displacement in rotation about the axis Z.

The seat 10 comprises means 50 for locking the upper part 14 relative to the substructure 16. These locking means 50 are controlled so as to be locked or released by means of a lever 52 equipped with an operating end 54 extending from inside this structure 16 outwards through an orifice 56 in the latter.

The locking means 50 comprise means for clamping two friction faces F1, F2 delimiting respectively the moveable upper wall 32 and the fixed lower wall 34. These friction faces F1, F2 extend substantially perpendicular to the axis Z.

The clamping means, carried by the pivot 30, comprise an end head of this pivot, the said end head forming a fixed jaw 58, and a moveable jaw 60 mounted axially slideably on the pivot 30. The moveable upper wall 32 and the fixed lower wall 34 extend between the fixed jaw 58 and the moveable jaw 60.

An anti-friction pad carried by the moveable upper wall 32 is in contact with the fixed jaw 58, so as to minimize the friction between the fixed jaw 58 and the moveable upper wall 32 when the latter is displaced perpendicular to the axis Z.

Figure 3:
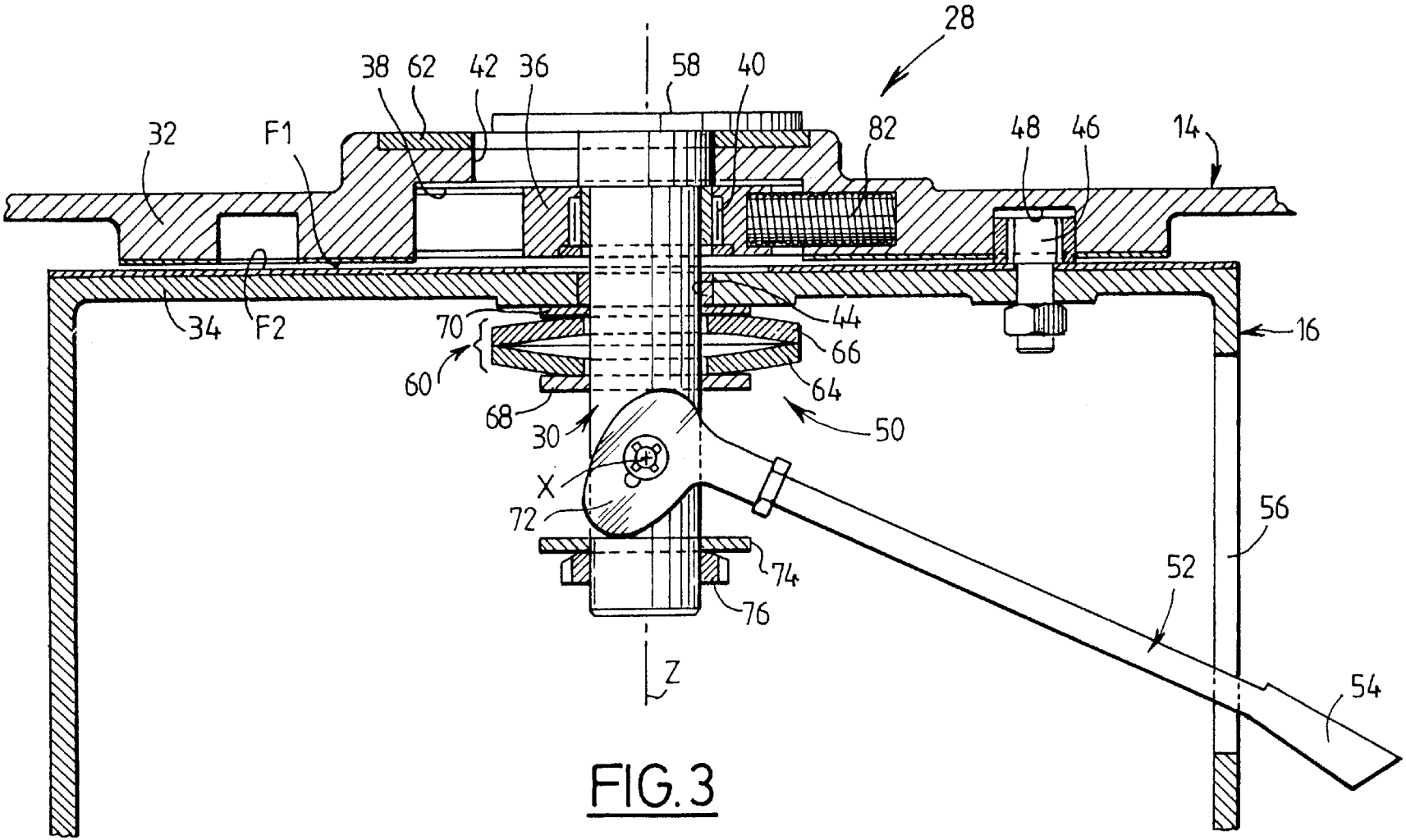
FIG. 3 is a sectional view along the line 3—3 of FIG. 2 in which the control lever is in the position for unlocking the moveable upper part of the seat.
Figure 4:
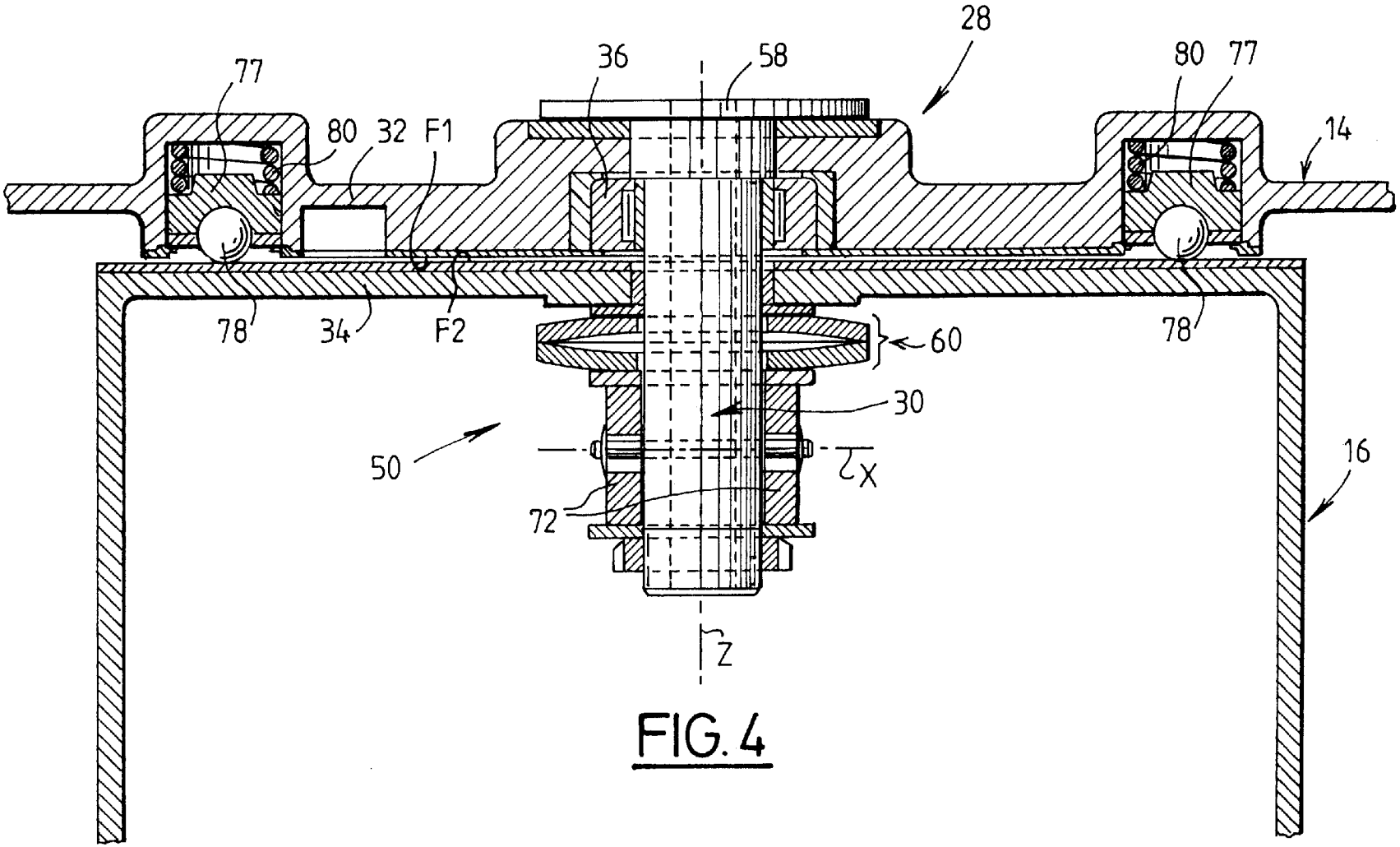
FIG. 4 is a sectional view along the line 4–4 FIG. 2.
Figure 5:
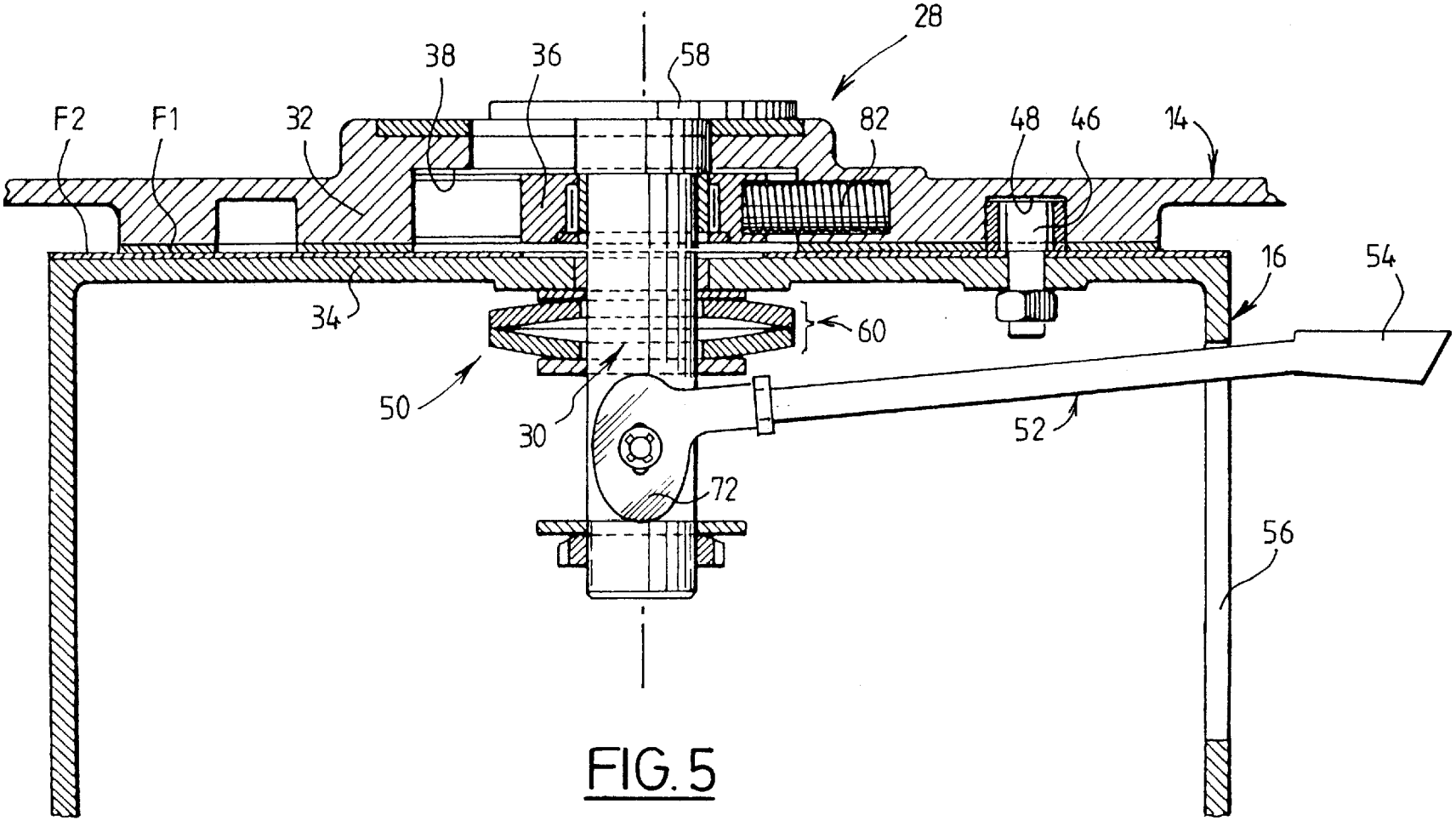
FIG. 5 is a view, similar to that of FIG. 3, in which the control lever is in the position for locking the moveable upper part of the seat.

The moveable jaw 60, deformable elastically in the direction of the axis Z, is displaceable between a decompressed position separating the friction faces F1, F2, as illustrated in FIGS. 3 and 4, and a compressed position clamping these friction faces F1, F2, as illustrated in FIG. 5.

The decompressed and compressed positions of the moveable jaw 60 correspond respectively to the unlocking and locking positions of the means 50.

The moveable jaw 60 comprises, for example, two elastic washers 64, 66 inserted between two plane washers 68, 70. The elastic washers 64, 66 are, for example, of the Belleville type.

The moveable jaw 60 is displaceable and compressible axially by co-operation with a cam 72 articulated on the pivot 30, if appropriate with play in the direction of the axis Z, about a geometric axis X substantially perpendicular to this axis Z.

It will be seen that the cam 72 forms preferably an articulated end of the control lever 52, the said end being operated at its other end 54.

It will also be seen that the cam 72 bears on a plane washer 74 immobilized axially by a stop nut 76 screwed onto that end of the pivot 30 which is opposite the fixed jaw 58.

In order to make it easier for the upper part 14 to be displaced relative to the substructure 16, the friction face F1 carried by the moveable upper wall 32 comprises rolling members 77 illustrated particularly in FIG. 4. Preferably, these members, of which there are, for example, three, each comprise a ball 78. Each ball 78 is displaceable substantially parallel to the axis Z between a projecting position spacing apart the friction faces F1, F2, in which position the ball 78 is in rolling contact with the friction face F2 of the substructure (see FIG. 4), and a retracted position, in which the friction faces F1, F2 are in contact with one another, so as to immobilize the upper part 14 of the seat relative to the substructure 16.

The main steps in turning the seat 10 according to the invention will be described below, particularly with reference to FIGS. 6 to 9.

Initially, the upper part 14 of the seat is in a first normal position of use of this seat, as illustrated in FIG. 6. The locking means 50 are activated (control lever 52 in the high position) so as to immobilize the upper part 14 relative to the substructure 16.

In order to turn the seat 10, the operator first lowers the control lever 52 (preferably with the foot) as far as its low position illustrated in FIG. 3, so as to release the locking means 50. The moveable upper part 14 can then be displaced relative to the substructure 16.

Figure 7:
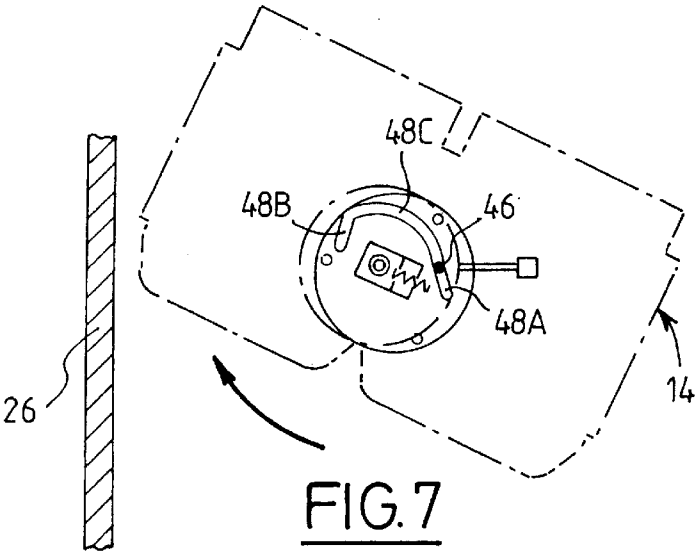
FIGS. 6 to 9 are diagrammatic top views of the seat illustrated in FIG. 1, showing the latter in successive positions during a seat-turning operation.
Figure 8:
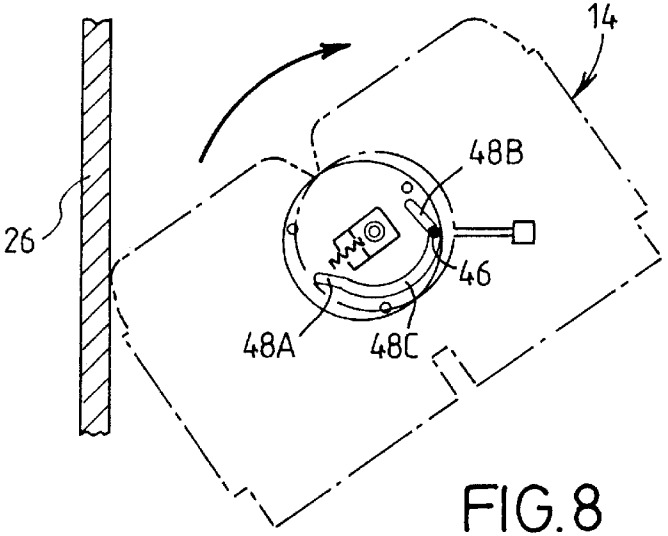

The operator then drives the upper part 14 of the seat manually by imparting to this upper part a general turning movement parallel to a horizontal plane and clockwise with reference to FIGS. 7 to 9.

The cam finger 46 then co-operates with the ramp 48A, the effect of which is to impart to the upper part 14 a combined translational movement, tending to move the upper part 14 away from the adjacent side wall 26 in a direction transverse to the axis Z, and a rotational movement about this axis Z (see FIG. 7). The translational displacement of the upper part 14 occurs as a result of the displacement of the slide 36 in its guide rail 38. The displacement of this slide 36 is preferably assisted by a compression spring 82 (see, in particular, FIG. 3) inserted between mutually confronting ends of this slide and of the rail 38. The rotational displacement of the upper part 14 occurs as a result of the rotation of the slide 36 about the pivot 30.

The cam finger 46 subsequently co-operates with the curved portion 48C, the effect of which is to cause the moveable part 14 to pivot about the axis Z so as to bring this part 14 into the position illustrated in FIG. 8. It will be seen that the positions of the moveable upper part 14 which are illustrated in FIGS. 7 and 8 are substantially symmetrical with respect to a transverse vertical plane of the vehicle.

Finally, the cam finger 46 co-operates with the second ramp 48B, the effect of which is to complete the turning of the moveable upper part 14 and bring this part 14 closer to the adjacent side wall 26, as illustrated in FIG. 9.

In order to immobilize the moveable upper part 14 in the second normal position of use of the seat, as illustrated in FIG. 9, the operator raises the control lever 52 as far as its position, as illustrated in FIG. 5, so as to activate the locking means 50 once again.

In order to return the seat to its position illustrated in FIG. 6, the operator displaces the upper part 14 along a path necessarily opposite to that described above. Thus, when the upper part 14 and the substructure 16 of the seat are equipped with electrical means (for example, motorizing means intended for driving the upper part 14), the electrical cables, which, if appropriate, extend between this part 14 and this substructure 16, do not risk being wound accidentally around the pivot 30 following successive rotations of the upper part 14 always in the same direction.

Among the advantages of the invention, it will be seen that the latter enables an operator to turn a seat very easily by driving the moveable upper part of the latter in a general turning movement, without this movement being impeded by the vehicle side wall near the seat.

Moreover, this movement can easily be automated with the aid of conventional command and control means (jack (s), rotary motor(s), etc.).

The control could be local (for example, one control pushbutton per seat) or centralized for all or some of the seats of a vehicle.

What is claimed is:

1. A seat,comprising a moveable upper part (14) for receiving at least one occupant, said moveable upper part being carried by a fixed lower part forming a substructure (16), and means (28) for turning the upper part (14) backwards and forwards, wherein the turning means (28) comprises a pivot (30) connecting the upper part (14) and the substructure (16), an axis (Z) of the pivot (30) being substantially vertical, a bearing-forming slide (36) mounted within the upper part (14) so as to be displaceable in rotation about the pivot (30) and in translational motion substantially perpendicular to the axis (Z) of the pivot (30), and first and second complementary cams (46, 48) carried respectively by the substructure (16) and the upper part (14), the first cam comprising a developing profile and forming a guide for the second cam extending substantially parallel to a plane perpendicular the axis of the pivot so as to impart a predetermined turning travel to the upper part (14).

2. The seat, according to claim 1, arranged in a rail vehicle.

3. The seat according to claim 1, wherein the guide (48) comprises two straight end portions forming ramps (48A, 48B) imparting to the upper part (14) displacements occurring as a result of a combination of a rotational movement about the axis (Z) of the pivot and of a translational movement substantially perpendicular to the axis (Z) of the pivot, and a curved intermediate portion (48C) imparting to the upper part (14) a displacement in rotation about the axis(Z) of the pivot.

4. A seat comprising a moveable upper part (14) for receiving at least one occupant, said moveable upper part being carried by a fixed lower part forming a substructure (16), and means (28) for turning the upper part (14) backwards and forwards, wherein the turning means (28) comprises a pivot (30) connecting the upper part (14) and the substructure (16), an axis (Z) of the pivot (30) being substantially vertical, a bearing-forming slide (36) mounted within the upper part (14) so as to be displaceable in rotation about the pivot (30) and in translational motion substantially perpendicular to the axis (Z) of the pivot (30), and first and second complementary cams (46, 48) carried respectively by the substructure (16) and the upper part (14), wherein one of the cams comprises a developing profile imparting a predetermined turning travel to the upper part (14), wherein the first cam forms a finger (46) integral with the substructure (16), and the second cam forms a guide (48) having a developing profile and formed in the upper part (14), the guide (48) extending substantially parallel to a plane perpendicular to the axis (Z) of the pivot (30).

5. The seat according to claim 4, wherein the guide (48) comprises two straight end portions forming ramps (48A, 48B) imparting to the upper part (14) displacements occurring as a result of a combination of a rotational movement about the axis (Z) of the pivot and of a translational movement substantially perpendicular to the axis (Z) of the pivot, and a curved intermediate portion (48C) imparting to the upper part (14) a displacement in rotation about the axis(Z) of the pivot.

6. A seat comprising a moveable upper part (14) for receiving at least one occupant, said moveable upper part being carried by a fixed lower part forming a substructure (16), and means (28) for turning the upper part (14) backwards and forwards, wherein the turning means (28) comprises a pivot (30) connecting the upper part (14) and the substructure (16), an axis (Z) of the pivot (30) being substantially vertical, a bearing-forming slide (36) mounted within the upper part (14) so as to be displaceable in rotation about the pivot (30) and in translational motion substantially perpendicular to the axis (Z) of the pivot (30), first and second complementary cams (46, 48) carried respectively by the substructure (16) and the upper part (14), wherein one of the cams comprising a developing profile imparting a predetermined turning travel to the upper part (14), and releasable means (50) for locking the upper part (14) relative to the substructure (16).

7. The seat according to claim 6, wherein the locking means (50) comprises means (58, 60) for clamping two mutually confronting friction faces (F1, F2) substantially perpendicular to the axis (Z) of the pivot and delimiting respectively the upper part (14) and the substructure (16), the clamping means being carried by the pivot.

8. The seat according to claim 7, wherein the pivot (30) extends through mutually confronting walls (32, 34) of the upper part (14) and of the substructure (16) carrying the friction faces (F1, F2), wherein the clamping means comprises an end head of the pivot (30), said end head forming a fixed jaw (58), and a moveable jaw (60) mounted axially slideably on the pivot (30), the mutually confronting walls (32, 34) extending between the fixed jaw (58) and the moveable jaw (60), the moveable jaw (60) being elastically deformable axially and being displaceable between a decompressed position separating the friction faces (F1, F2) and a compressed position clamping the friction faces (F1, F2).

9. The seat according to claim 8, wherein the moveable jaw (60) is displaceable and compressible axially by co-operation with a third cam (72) articulated on the pivot (30) about an axis (X) substantially perpendicular to the axis (z) of the pivot (30).

10. The seat according to claim 9, wherein the third cam (72) forms an end of a lever (52) controlling the locking means (50).

11. The seat according to claim 7, wherein one of the friction faces (F1) of the upper part (14) comprises rolling members, displaceable substantially parallel to the axis (Z) of the pivot between the projecting position spacing apart the mutually confronting friction faces (F1, F2), wherein the members are in rolling contact with the other friction face (F2) of the substructure (16), and the retracted position putting the mutually confronting friction faces (F1, F2) into contact, the rolling members being returned elastically to the projecting position.

12. A rail vehicle comprising a seat having a moveable upper part (14) for receiving at least one occupant, said moveable upper part being carried by a fixed lower part forming a substructure (16), and means (28) for turning the upper part (14) backwards and forwards, wherein the turning means (28) comprises a pivot (30) connecting the upper part (14) and the substructure (16), an axis (Z) of the pivot (30) being substantially vertical, a bearing-forming slide (36) mounted within the upper part (14) so as to be displaceable in rotation about the pivot (30) and in translational motion substantially perpendicular to the axis (Z) of the pivot (30), and first and second complementary cams (46, 48) carried respectively by the substructure (16) and the upper part (14), the first cam comprising a developing profile and forming a guide for the second cam extending substantially parallel to a plane perpendicular the axis of the pivot so as to impart a predetermined turning travel to the upper part (14).

* * * * *